US008499778B2

(12) United States Patent
Ha et al.

(10) Patent No.: US 8,499,778 B2
(45) Date of Patent: Aug. 6, 2013

(54) TENT AND CONTROL DEVICE OF TENT CONNECTING ROD

(75) Inventors: Ki Joon Ha, Seoul (KR); Ki Yun Ha, Suwon-si (KR)

(73) Assignee: Woogyo Co., Ltd., Seoul (KR)

( * ) Notice: Subject to any disclaimer, the term of this patent is extended or adjusted under 35 U.S.C. 154(b) by 0 days.

(21) Appl. No.: 13/484,661

(22) Filed: May 31, 2012

(65) Prior Publication Data

US 2012/0312342 A1 Dec. 13, 2012

(30) Foreign Application Priority Data

Jun. 13, 2011 (KR) ..... 10-2011-0057011

(51) Int. Cl.
*E04H 15/36* (2006.01)

(52) U.S. Cl.
USPC ..... 135/135; 135/28; 135/159; 135/120.3; 403/170; 403/217

(58) Field of Classification Search
USPC ..... 135/98, 135, 143–144, 147, 159, 135/28, 30, 120.3; 403/170–173, 217–219; 52/81.1, 646, 656.9, 883
See application file for complete search history.

(56) References Cited

U.S. PATENT DOCUMENTS

| | | | | | |
|---|---|---|---|---|---|
| 2,948,287 | A * | 8/1960 | Rupert | 135/126 |
| 4,074,682 | A * | 2/1978 | Yoon | 135/135 |
| 4,148,332 | A * | 4/1979 | Huddle | 135/123 |
| 5,230,358 | A * | 7/1993 | Forell | 135/98 |
| 5,795,012 | A * | 8/1998 | Liou et al. | 296/136.13 |
| 6,076,540 | A * | 6/2000 | You | 135/22 |
| 6,397,872 | B1 * | 6/2002 | Carter | 135/145 |
| 7,341,071 | B2 * | 3/2008 | Lee | 135/128 |
| 7,644,720 | B2 * | 1/2010 | Chen | 135/135 |
| 7,644,721 | B2 * | 1/2010 | Hoberman et al. | 135/144 |
| 7,997,290 | B2 * | 8/2011 | Stoelinga | 135/20.3 |
| 2002/0074032 | A1 * | 6/2002 | Park et al. | 135/131 |

FOREIGN PATENT DOCUMENTS

KR 20-0372631 Y1 1/2005

* cited by examiner

*Primary Examiner* — Winnie Yip
(74) *Attorney, Agent, or Firm* — LRK Patent Law Firm

(57) ABSTRACT

A tent is safely unfolded or folded when used and requires less time to unfold or fold and can be pitched automatically as well as manually to solve the problems of the prior art. In the tent, a worm gear and worm wheels are combined and tent connecting rods are attached to the worm wheels, respectively, so that when the worm wheels are moved, the tent connecting rods are moved to fold or unfold the tent. The worm wheel can be manually moved within the tent or the worm wheel can be automatically operated by providing a motor controlled through a remove controller so that the tent connecting rods can be unfolded or folded. In the tent, a central cavity part of a worm wheel body may be used as an air vent, and used as a passage for a smoke outlet from a heater in the winter.

5 Claims, 7 Drawing Sheets

TENT AND CONTROL DEVICE OF TENT CONNECTING ROD

BACKGROUND

1. Field

The present invention relates to a technology for a tent, and more particularly, to a highly flexible and durable tent, a tent connecting rod and a device configured to control the connecting rod to automatically fold or unfold the tent.

2. Description of the Related Art

A conventional tent connecting rod for a tent does not satisfy both of flexibility and durability requirements. Therefore, what is required is to provide a tent connecting rod that can satisfy both of the requirements. In order to unfold or fold a large-sized tent as well as a small-sized tent, it is necessary for many people to cooperate with each other and to spend much time, which causes an inconvenient and dangerous situation and hence blocks the popularization of tent.

Therefore, what is needed is to solve this problem and to provide a durable tent which has an improved torsional strength to endure an external factor, such as the wind rising outside the tent, and is beautiful when in use.

SUMMARY

The present invention has been made in view of the above-mentioned problems, and an aspect of the present invention is to provide a tent which is safely unfolded or folded when used and requires less time to unfold or fold the tent, and can be folded and unfolded automatically as well as manually. In addition, the present invention is to provide a separate tent connecting rod with reduced thickness and improved torsional strength of the pole as well as to increase the elasticity of the pole in the longitudinal direction, so that the shape of the tent looks beautiful when used.

Another aspect of the present invention is to provide an all-weather tent of which a central cavity part may be used as an air vent, and also used as a passage for a smoke outlet from a heater in the winter, so that the tent can be used throughout four seasons.

In the first exemplary embodiment as illustrated in FIG. 2, a plurality of worm gears 31 and a worm wheel 22 are engaged with each other so that the worm gears 31 are rotated as the worm wheel 22 is rotated, in which tent connecting rods 30 are attached to the worm gears 31, respectively, to be rotated when the worm gears 31 are rotated. A tent is configured to be folded or unfolded as the tent connecting rods 30 are moved. When the tent is manually operated, it is possible to rotate the worm wheel 22 in the inside of the tent to fold or unfold the tent.

The teeth of each of the worm gears 31 preferably have a radius of curvature which is the same with that of the teeth of the worm wheel 22.

Reference numeral 100 in FIG. 6 indicates a tent connecting rod control device, which is upside down as compared to that illustrated in FIGS. 1 to 4, in which it is possible to manually operate the structure within the tent or to automatically operate the structure by a small motor.

In addition, it is possible to provide a motor operated by a remote controller to rotate the worm wheel 22, so that the tent connecting rods 30 can be unfolded or folded.

The motor is adapted to be joined to an optional part on the case 10 or the case body 40 of the tent connecting rod control device 100, in which the motor may be removed and separately stored after the tent is unfolded or folded.

A cavity, which is formed through the center of the worm wheel body 20, may serve as an air vent for the tent, and, in the winter, may be used as a passage through which a smoke outlet of a heater extends in the winter.

Reference numeral 21 in FIG. 2 indicates a bearing configured to reduce frictional force produced when the worm wheel 22 is rotated. In the tent connecting rod control device 100, slits 12 in the case 10 may serve as passages for the tent connecting rods 30 together with slits 41 in the case body 40 when the tent connecting rods 30 are folded or unfolded.

Reference numeral 100 in FIG. 6 indicates a tent connecting rod control device, which is upside down as compared to that illustrated in FIGS. 1 to 4, in which it is possible to manually operate the structure within the tent or to automatically operate the structure by a small motor.

The motor is adapted to be joined to an optional part on the case 10 or the case body 40 of the tent connecting rod control device 100, in which the motor may be removed and separately stored after the tent is unfolded or folded.

A cavity, which is formed through the center of the worm wheel body 20, may serve as an air vent for the tent, and, in the winter, may be used as a passage, through which a flue of a heater extends.

Reference numeral 21 in FIG. 2 indicates a bearing configured to reduce frictional force produced when the worm wheel 22 is rotated. In the tent connecting rod control device 100, slits 12 in the case 10 may serve as passages for the tent connecting rods 30 together with slits 41 in the case body 40 within the moving range of the tent connecting rods 30 when folded or unfolded.

In accordance with the second exemplary embodiment of the present invention, as illustrated in FIG. 5, each of the tent connecting rods 300 may be formed substantially in a "∞" or peanut-shaped cross-section to solve a problem of the prior art. With this cross-section, it is possible to improve the elasticity as well as rigidity of each of the tent connecting rods 300 in the longitudinal direction thereof and to make the tent connecting rods 300 rigid without increasing the volume or weight thereof.

Due to increased torsional strength, the tent connecting rods 300 prevent the tent from rolling from side to side.

In accordance with the third exemplary embodiment, as illustrated in FIG. 6, reference numeral 60 indicates a tent settlement wire joined to the lowermost edge of the tent, in which a wire may be joined to the tent settlement wire or a durable string may be introduced into the tent settlement wire so that the tent connecting rods 30 and 300 may not move away from a predetermined range when the tent is unfolded using the tent connecting rod control device.

In accordance with the fourth exemplary embodiment, as illustrated in FIG. 1, the tent connecting rod control device 100 is fabricated from a fire-resistant material so that the central cavity part of the worm wheel body may be used as an air vent, and in the winter, may be used as a passage for a smoke outlet from a heater, whereby the tent can be used throughout the four seasons.

In accordance with the fifth exemplary embodiment, reference numeral 60 in FIG. 6 indicates a tent settlement wire. An existing tent includes conventional connecting rods which should be settled one by one after being extended longitudinally. Therefore, two or more people are essentially required to pitch the tent, which may cause a dangerous situation.

After each of the tent connecting rods is bent to a certain degree, the tent connecting rods are tied with one or more straps so that the tent connecting rods cannot be released from each other, and after the tent is pitched, the straps should be loosed again since a user's feet may become entangled in the tied straps when the user walks within the tent.

However, since the present invention connects the tent settlement wire 60 prior to operating the tent connecting rod control device 100, no danger will be caused, and the user may unfold or fold a large-sized tent without help.

Typically, the tent settlement wire 60 may be formed by a wire, a flexible string or the like.

In accordance with the sixth embodiment, as illustrated in FIG. 7, there is provided a case which is configured to store the tent including tent connecting rods 30 and the tent connecting rod control device 100, and is simple and easy to store.

DETAILED DESCRIPTION

Figure 1:
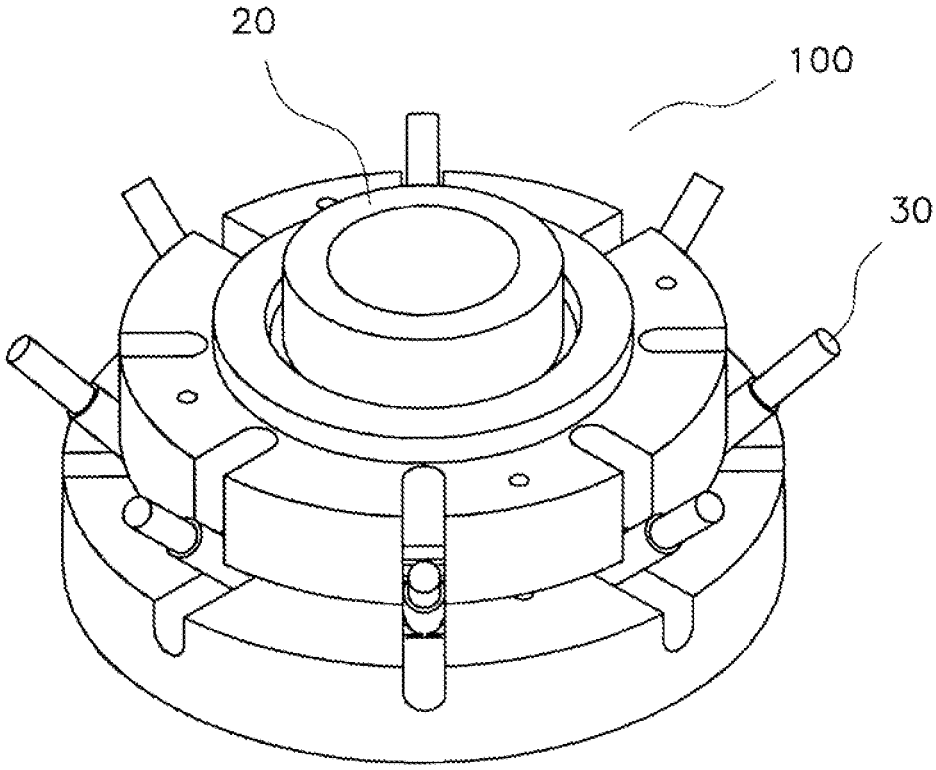
FIG. 1 is a perspective view illustrating a tent connecting rod control device.

The inventive tent connecting rod control device includes: a worm wheel body 20 which is formed with a worm wheel 22 on the outer circumferential surface thereof; a worm gear 31 which is engaged with the worm wheel 31 to be rotated as the worm wheel body 20 is rotated; a tent connecting rod 30 fixed to a side of the worm gear 31 to be integrally rotated with the worm gear 31; and a case 10 and a case body 40 which are configured to rotatably support the worm wheel body 20 and the worm gear 31 at the top and bottom of the worm wheel body 20 and the worm gear 31, respectively, wherein the tent connecting rod 30 is configured to be operated in cooperation with the rotation of the worm wheel body 20 in such a manner that the tent connecting rod 30 is unfolded or folded depending on the rotation direction of the worm wheel body 20.

Various aspects are now described with reference to the drawings.

FIG. 1 is a perspective view illustrating a tent connecting rod control device, in which reference numeral 30 indicates tent connecting rods which are attached to worm gears 31, respectively. The tent connecting rods 30 form a mechanism for serving to unfold or fold the tent by being moved up or down when a worm wheel body 20 is rotated.

Figure 2:
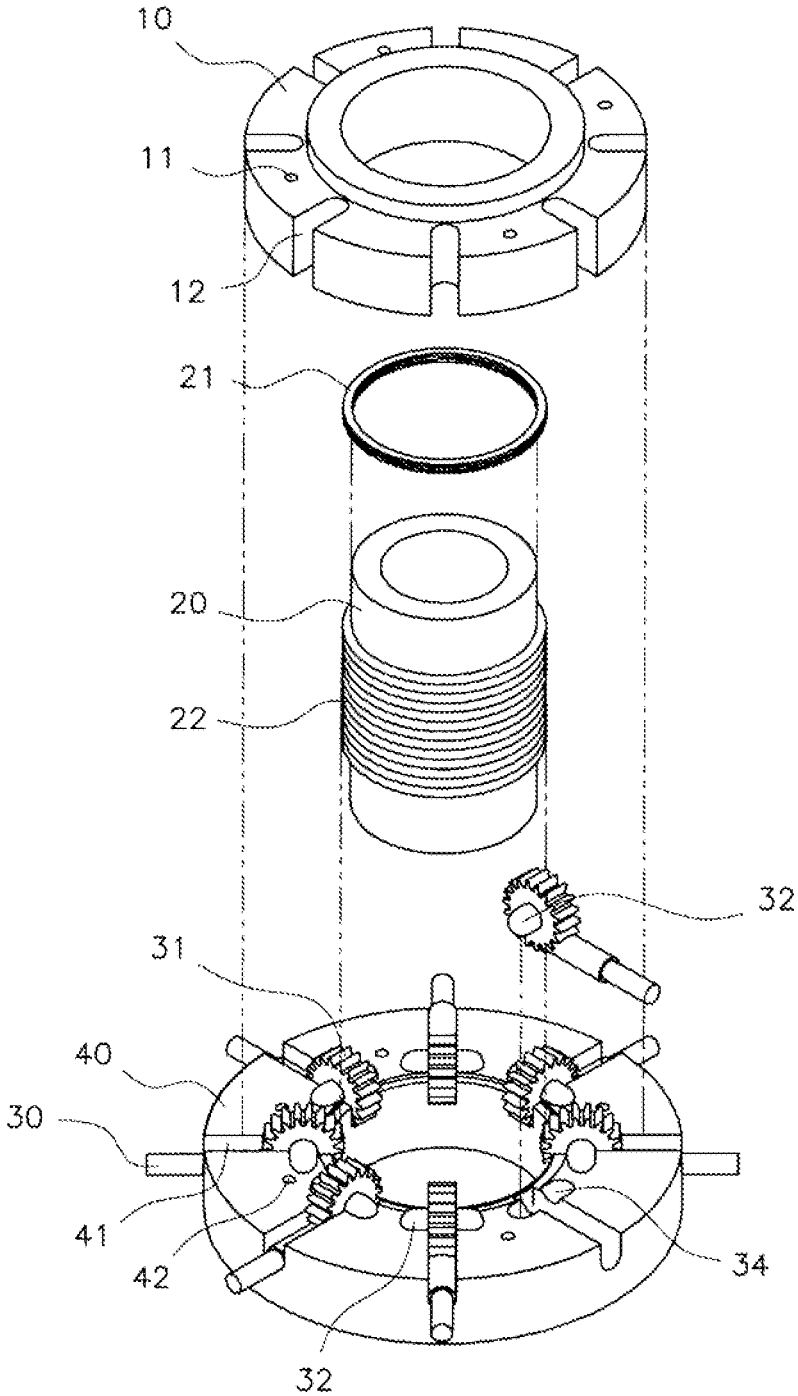
FIG. 2 is an exploded perspective view of the tent connecting rod control device of FIG. 1 which employs a worm wheel and worm gears.

FIG. 2 is an exploded perspective view of the tent connecting rod control device of FIG. 1, in which the worm wheel 22 and the components of the mechanism for controlling the tent connecting rods 30 are arranged in an assembling sequence. Reference numeral 10 indicates a case for the tent connecting rod control device. The mechanism for controlling the tent connecting rods 30 of the tent is configured in the following manner. When the case 10 is assembled to a case body 40, the tent connecting rods 30 are assembled to the case body 40, and the worm wheel body 20 is seated in a central cavity part in the case body 40. The worm wheel body 20 is formed with a screw thread to have a predetermined length that allows each of the worm gears 31 to be rotated by 90 degrees. In order to prevent the abrasion of the worm wheel body 20 due to frictional force produced as the worm wheel body 20 is rotated, a bearing 21 is arranged above the screw thread.

Reference numeral 11 indicates fastening means for fastening the case 10 and the fastening holes 42 with each other, reference numerals 12 and 41 are slits formed as moving spaces in the case 10 and the case body 40 to allow the tent connecting rods 30 to be moved, reference numeral 21 indicates the bearing arranged between the case 10 and the case body 40 to prevent heat generation when the worm wheel 22 is rotated, and to ensure the smooth movement, and reference numeral 22 indicates the worm wheel. When the worm wheel 22 is rotated, the worm gears 31 are also rotated, and the tent connecting rods 30, each of which is attached to one of the worm gears 31, are moved to fold or unfold the tent.

Reference numeral 32 indicates a worm gear settling part, reference numeral 40 indicates the case body, and reference numeral 41 indicates the slits. Worm gear settling parts 32 are protruded along a direction of an axis of the worm gear 31. Further, settling holes 34 are provided at the case 10 and the case body 40, respectively, so that the worm gear settling parts 32 are inserted and supported when the ease 10 and the case body 40 are assembled.

In order to manually rotate the worm wheel 22, it may be possible to form holes in a lower part of the worm wheel body 20 diametrically through the worm wheel body, to fit a rigid pole in the hole, and to manually rotate the worm wheel body 20 using the pole. In order to automatically rotate the worm wheel 22, a small motor may be mounted at any place on the case 10 or the case body 40 to be manipulated through a switch or a remote controller.

Figure 3A:
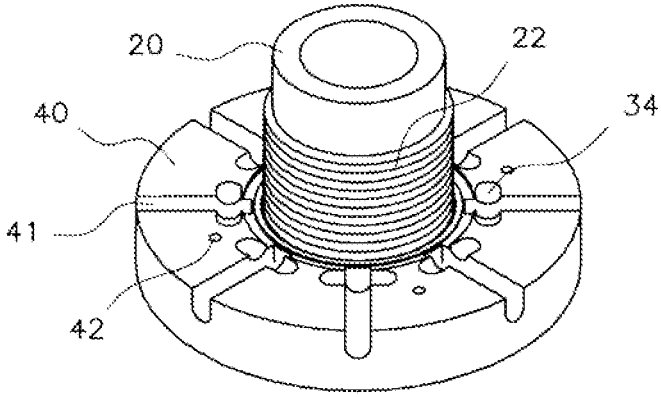
FIGS. 3A to 3C show partially-assembled views illustrating the sequence to assemble the tent connecting rod control device of FIG.1
Figure 3B:
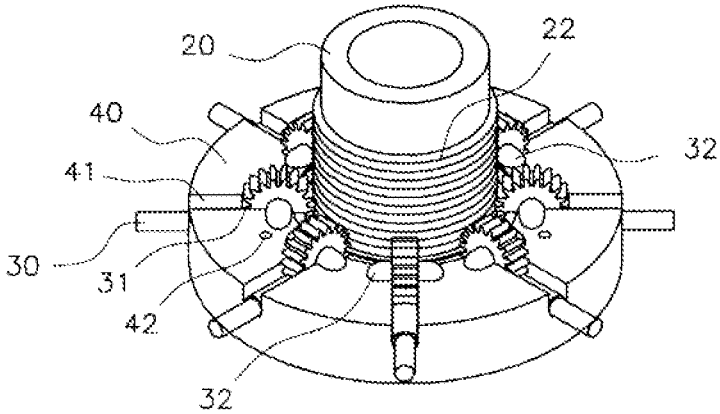
Figure 3C:
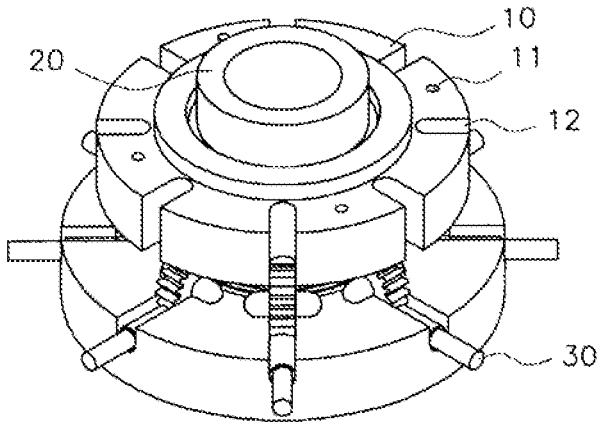

FIGS. 3A to 3C show partially-assembled views illustrating the sequence to assemble the tent connecting rod control device of FIG. 1.

Figure 4:
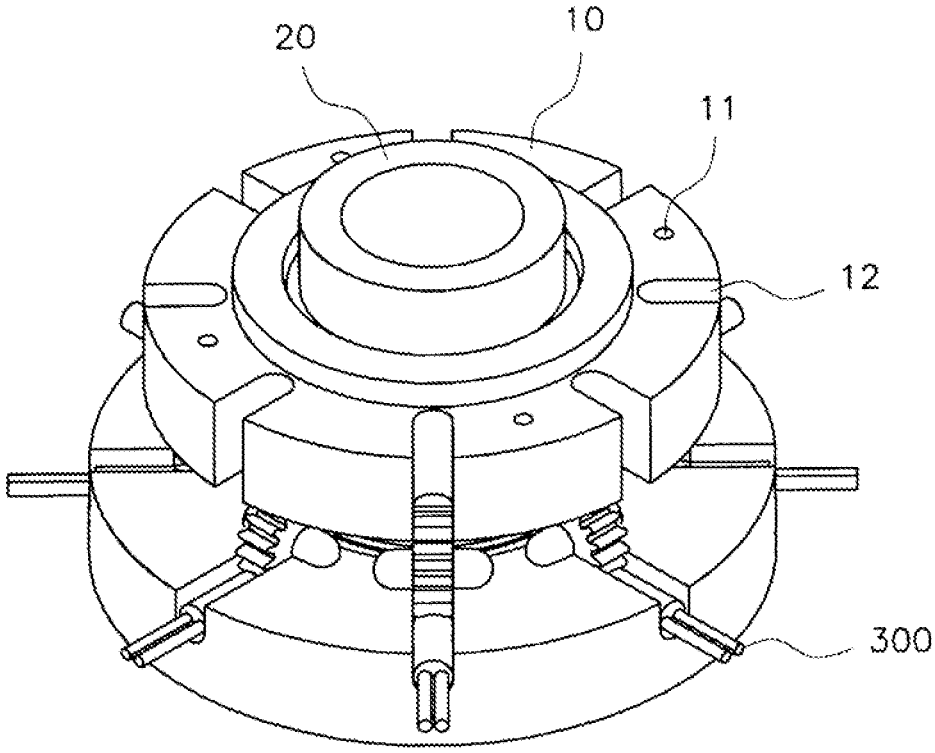
FIG. 4 is a perspective view illustrating the tent connecting rod control device of FIG. 1, to which the inventive tent connecting rods are applied, in a state in which the case is slightly lifted.
Figure 5:
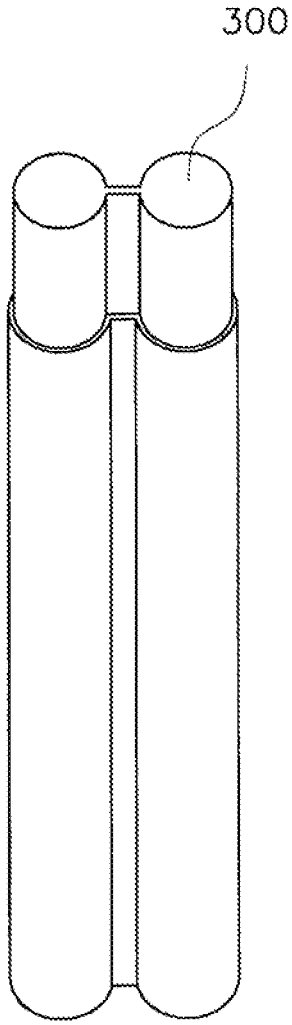
FIG. 5 is a perspective view illustrating the inventive tent connecting rod.

FIG. 4 illustrates the inventive tent connecting rod control device, to which the tent connecting rods 300, one of which is illustrated in FIG. 5, are applied.

FIG. 5 illustrates a tent connecting rod 300 formed substantially in a "∞" or peanut-shaped cross-section in order to increase the elasticity and torsional strength of the tent connecting rod 300, which can satisfy both of the elasticity and torsional strength requirements for the tent connecting rod 300 while reducing the volume and weight of the tent connecting rod 300. With this construction, it is possible provide a tent which has an improved torsional strength to endure an external factor, such as the wind rising outside the tent, and is durable and beautiful when in use due to the tent connecting rods 300 which are excellent in elasticity and torsional strength.

Figure 6:
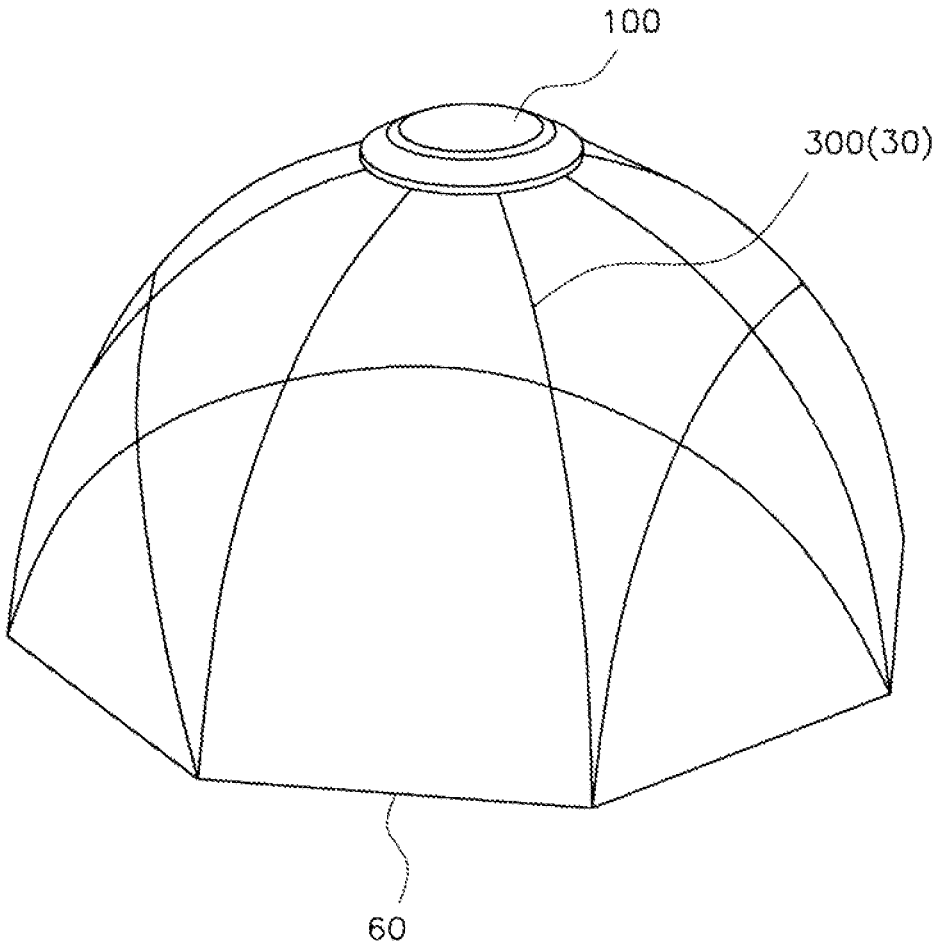
FIG. 6 is a schematic view illustrating a use of a tent, to which the inventive tent connecting rod control device is applied.

FIG. 6 is a perspective view illustrating a tent provided with the inventive tent connecting rod control device 100 in the used state as the tent connecting rods 30 and 300 are unfolded, in which the inventive tent connecting rod control device 100 is depicted in the upside-down position as compared to that illustrated in FIGS. 1 to 4. When the worm wheel body 20 and hence the worm wheel 22 are manually rotated within the tent or automatically rotated by a small motor controlled by a remote controller, the tent connecting rods indicated by reference numerals 30 and 300 can be unfolded or folded.

Reference numeral 60 indicates a tent settlement wire. An existing tent includes tent connecting rods which should be settled one by one after being extended longitudinally. Therefore, two or more people are essentially required to pitch the tent, which may cause a dangerous situation.

After each of the tent connecting rods is bent to a certain degree in the conventional tent, the tent connecting rods are tied with one or more straps so that the tent connecting rods cannot be released from each other, and after the tent is pitched, the straps should be loosed again since a user's feet may become entangled in the tied straps when the user walks within the tent.

However, since the tent in the present invention connects the settlement wire 60 prior to operating the tent connecting rod control device 100, no danger will be caused, and the user may unfold or fold a large-sized tent without help.

The settlement wire 60 may be formed by a wire, a flexible string or the like.

Figure 7:
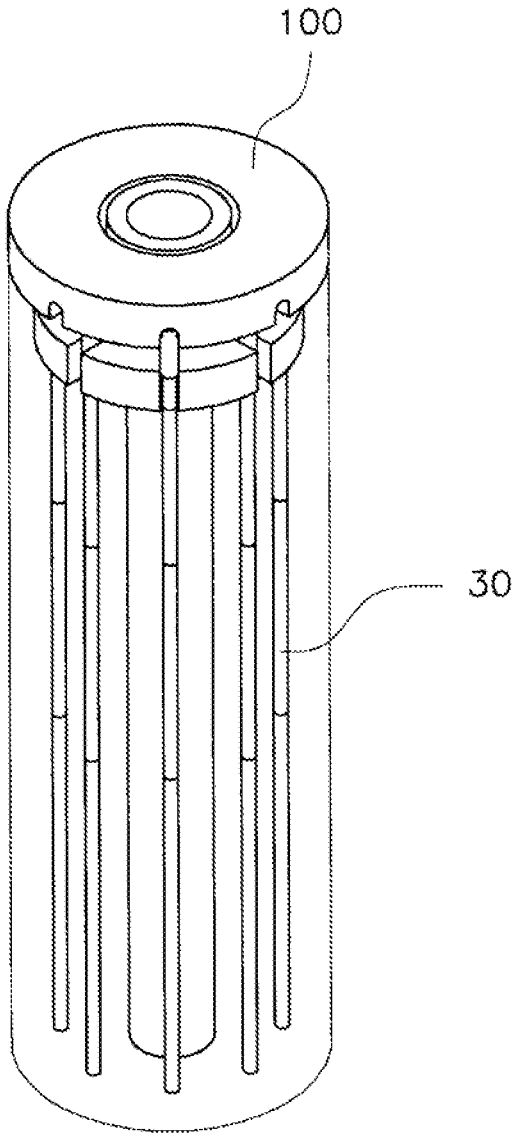
FIG. 7 is a perspective view illustrating the inventive tent storage container.

FIG. 7 is a perspective view illustrating the inventive tent storage container which is configured to be simple and to conveniently store the tent, in which the tent connecting rod control device 100 is configured to form one side of the tent storage container. The tent storage container may be formed from fabric or plastic and is beautiful and easy to store like a golf bag.

As apparent from the above description, conventional tents have a problem in that in order to unfold or fold a large-sized tent as well as a small-sized tent, it is necessary for many people to cooperate with each other and to spend much time, which causes an inconvenient and dangerous situation and hence blocks the popularization of tent. The present invention solves this problem to contribute to the popularization of tent, and allows a tent to be pitched within a very short length of time. In addition, conventional tent connecting rods do not satisfy both of the flexibility and durability requirements. The present invention provides tent connecting rods that can satisfy both of the requirements. By improving the torsional strength and elasticity of the tent connecting rods, the present invention provides a tent which is capable of enduring an external factor, such as the wind rising outside the tent, and is durable and beautiful when in use.

Since the central cavity part of the worm wheel body may be used as an air vent and be used as a passage for a smoke outlet from a heater in the winter, the inventive tent can be used throughout the four seasons.

Since a wire or a durable strap is inserted along the lowermost edge of the inventive tent, no danger is caused and the tent connecting rods are prevented from being released beyond a predetermined range when the tent connecting rods are unfolded.

Two or more people are essentially required to pitch a conventional tent since the tent connecting rods of the conventional tent should be settled one by one after being extended longitudinally, which may cause a dangerous situation.

After each of the tent connecting rods of the conventional tent is bent to a certain degree, the tent connecting rods are tied with one or more straps so that the tent connecting rods cannot be released from each other, and after the tent is pitched, the straps should be loosed again since a user's feet may become entangled in the tied straps when the user walks within the tent.

However, the present invention does not cause danger and allows a user to unfold or fold a large-sized tent without help since the tent settlement wire is connected prior to unfolding the tent connecting rods.

In addition, the present invention provides a simple and convenient tent storage container which is configured to conveniently store a tent.

While the present invention has been described with respect to the specific embodiments, it will be apparent to those skilled in the art that various changes and modifications may be made without departing from the spirit and scope of the invention as defined in the following claims.

What is claimed is:

1. A tent connecting rod control device comprising:

a worm wheel body which is formed with a worm wheel on an outer circumferential surface thereof;

a worm gear which is engaged with the worm wheel to be rotated as the worm wheel body is rotated;

a tent connecting rod fixed to a side of the worm gear to be integrally rotated with the worm gear; and a case and a case body which are configured to rotatably support the worm wheel body and the worm gear at the top and bottom of the worm wheel body and the worm gear, respectively, wherein worm gear settling parts are provided along a direction of an axis of the worm gear, settling holes are provided at the case and the case body, respectively, so that the worm near settling parts are inserted and supported when the case and the case body are assembled, and the case is provided with a slit to which the tent connecting rod is guided when the tent connecting rod is rotated as the worm gear is rotated by the rotation of the worm wheel body, and wherein the tent connecting rod is configured to be operated in cooperation with the rotation of the worm wheel body in such a manner that the tent connecting rod is unfolded or folded depending on the rotation direction of the worm wheel body.

2. The device as claimed in claim 1, wherein the tent connecting rod is extended from the worm gear along a tangential direction of the worm gear.

3. The device as claimed in claim 1, wherein a hole is formed in a lower part of the worm wheel body diametrically through the worm wheel body.

4. The device as claimed in claim 1, further comprising a bearing arranged on an upper part of the worm wheel.

5. A tent comprising the tent connecting rod control device as claimed in claim 1, and a flexible settlement wire applied to a lower edge of the tent to bind the tent connecting rods with a regular interval.

* * * * *